US005586509A

United States Patent [19]

Mangold et al.

[11] Patent Number: 5,586,509

[45] Date of Patent: Dec. 24, 1996

[54] CARD TABLE FOOD, BEVERAGE, BIDDING BOX AND CONVENTION CARD HOLDING APPARATUS

[76] Inventors: Howard L. Mangold, 458 Sharon Dr., San Antonio, Tex. 78216; Anita L. Mangold, 4026 Georgetown Rd., Blue Ash, Ohio 45236

[21] Appl. No.: 447,396

[22] Filed: May 23, 1995

[51] Int. Cl.[6] ..... A47B 41/04

[52] U.S. Cl. ..... 108/28; 108/152; 108/65

[58] Field of Search ..... 108/26, 28, 62, 108/65, 42, 49, 186, 185, 144, 152

[56] References Cited

U.S. PATENT DOCUMENTS

| | | | |
|---|---|---|---|
| 1,012,856 | 12/1911 | Irving | 108/62 |
| 2,201,187 | 5/1940 | Levin | 108/28 |
| 3,111,297 | 11/1963 | Conver | 108/144 |

FOREIGN PATENT DOCUMENTS

| | | | |
|---|---|---|---|
| 0772210 | 10/1934 | France | 108/28 |
| 0843704 | 6/1939 | France | 108/159 |

*Primary Examiner*—Peter M. Cuomo
*Assistant Examiner*—Gerald A. Anderson

[57] ABSTRACT

A food, beverage, bidding box and convention card holding system for mounting on a card table having a card table leg assembly. The system includes a platform for holding beverages and food, a holder for cards used to make bids in the game called contract bridge ("bridge"), a holder for the convention card used in the bidding process in bridge, and a mounting leg that attaches to the bottom of the platform and mounts to the table leg using spring-loaded clamps for easy mounting and removal from the card table. The spring-loaded clamps allow the apparatus to be independently supporting, without regard to the configuration of the card table or the table leg brace or strut.

12 Claims, 4 Drawing Sheets

CARD TABLE FOOD, BEVERAGE, BIDDING BOX AND CONVENTION CARD HOLDING APPARATUS

BACKGROUND OF THE INVENTION

The present invention relates to card games and more particularly to bridge. The invention is an improved card table mounted, portable, combination food, beverage, bidding box and convention card holding apparatus.

Folding tables for playing cards and other games are sized and configured to seat a number of persons around the table and include a smooth planar playing area accessible by each of the players. Such tables generally have four legs which are positionable between a stowage position and an open playing position. Typical card tables include a slotted brace member and a pivotable strut member for supporting each leg in the open position.

Because card games are often of fairly long duration, players often consume food and beverages, or smoke cigarettes, while playing. Because the table playing surface area is limited, placement of consumables on the table can result in spillage or other damage to the cards or other game accouterments and the table.

Bridge is a partnership game, and there are two players to each partnership. Players are each given a name—North, South, East and West. These names are similar to points on the compass, in the sense that North sits opposite South, and East sits opposite West. North and South are a partnership, as are East and West. Prior to commencement of play of each hand, an auction is conducted to decide which suit of the four (spades, hearts, diamonds or clubs) will be the trump suit, the cards in the trump suit having more power to win tricks than the cards in any other suit. Also decided is which partnership will be the defense, and which partnership will contract to win a certain number of tricks. A trick includes the play of one card from each player's hand, and the player who plays the most powerful card wins the trick.

In the duplicate form of contract bridge in particular, bidding boxes and convention cards are used to conduct a silent auction in order to avoid any vocal inflections that, in a verbal auction, might give one's partner unauthorized information about the contents of one's hand. One's hand includes 13 of the 52 cards that have been dealt to one, out of the total of 52 cards in the deck. Each of four players is dealt 13 out of 52, or ¼ of the number of cards in the deck. In duplicate bridge, the cards patterns (or "hands") are dealt and put into a holder called a board. The board keeps each of the four hands from getting mixed up. After a certain number of hands are dealt and played, the boards, as well as the East-West pairs, move from table to table, so that the players, as well as the hands in each board, are played by different partnerships throughout the bridge session. The results, or scores, are compared at the end of the playing period, and whichever pairs had the best results, when the scores from all boards are compared, win the bridge session.

Convention cards are used to fully inform one's opponents of special arrangements (called "conventions") used in the bidding process that precedes each hand of bridge. Conventions are bids whose meaning has been agreed upon in advance by the partnership. The conventions relay information regarding the shape (number of spades, hearts, diamonds and clubs) as well as the strength (number of powerful cards) in one's hand.

Accordingly, it would be desirable to provide a holder for supporting food, beverages, bidding boxes and convention cards which are readily and conveniently accessible to the players but that reduce the possibility of spillage of the food, beverages, bidding cards and convention cards.

Further, it would be desirable for the apparatus to be easily moved from card table to card table. The apparatus should not interfere with storage of the table in its storage position. Additionally, the apparatus should be so structured and configured so as to avoid its coverage of the table top altogether and minimize infringement into the table area and spaces adjacent to the table that are customarily considered to be the space of other players. The apparatus should be flexible enough so that the bidding box and convention card holder may be detached and not used should only food and beverages be required by the players. The apparatus should also have lateral stability so that if it is bumped into, it will resist collapsing or moving laterally. The apparatus should be so structured as to eliminate the possibility that the clamps attaching the apparatus to the table will mar the table leg's finish.

Prior art U.S. patents in the field are: U.S. Pat. Nos. 1,962,575; 2,185,907; 3,270,694; 3,881,677; 4,099,470; 4,878,642; 5,070,795; 5,169,108; and, 5,285,991; to Silverman, Alexander, Wallace et al., Ihlenfeld, Cannon, Jr., Kirby, Jr. Redlin et al., Carlson, and Carlson, respectively. Each of these references is hereby incorporated by reference for all disclosed.

SUMMARY OF THE INVENTION

It is therefore the primary object of the present invention to provide a food, beverage, bidding box and convention card holder for a card table directed to the foregoing objects and advantages. To that end, a removable card table mounted food, beverage, bidding box and convention card holder may include in a preferred aspect a food and beverage holding platform, which rests on and is fixed to a support leg that clamps to the table leg with spring-loaded metallic clamps, which are covered by rubber tubing that reduces the possibility that the clamps will mar the table leg.

DESCRIPTION OF THE PREFERRED EMBODIMENTS

Figure 1:
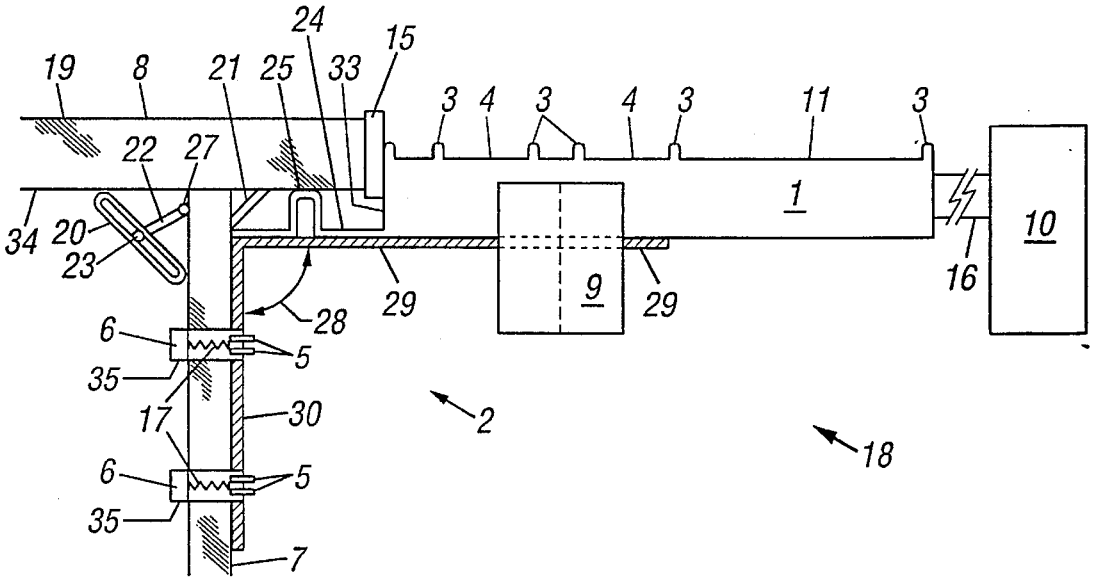
FIG. 1 is a side view of a food, beverage, bidding box and convention card holder, as mounted on a collapsible card table.

With reference now to FIG. 1, the food and beverage holder 18 is shown as being mounted on a collapsible card table 19, which is set up in the playing position. The collapsible card table includes a generally planar table top 8, having a peripheral railing 15. Extending generally perpendicularly and downwardly from the underside of the table top 8 is a table leg assembly including a leg 7, which is one of four legs used to support the table top 8 in an upright, horizontal playing position. Table leg 7 is stabilized and supported in the open position by means of a slotted support 20 and a stabilizing strut 21. The table leg 7 is slidably disposed in the slotted support 20 by means of a laterally extending projection 22 having an enlarged end portion that is spaced laterally from the table leg 7. Typically, the projection 22 would be formed from a bolt having a rivet-like head 23.

The stabilizing strut 21 is pivotally mounted at one end to the underside of the table top 8, and at the other end to the table leg 7, on the side opposite the projection 23. The stabilizing strut 21 is partially attached to the table leg 7 by means of a rivet or other suitable fastener 27. In some table configurations, the slotted support 20 is positioned on the player's left. Some different support configurations eliminate the slotted support 20 and the stabilizing strut 21 in favor of other configurations (not shown). Further, the different support configurations may result in the inclination of the table legs 7 to be at a different angle relative to the table top 8 than 90 degrees, or perpendicular. It should be understood and appreciated that the food, beverage, bidding box and convention card holder now being considered is independent of the type of support configuration used to stabilize the table leg 7 when in the open position and holding the table top 8 in an upright, horizontal playing position. It should also be understood and appreciated that the support leg or brace 2 of the food, beverage, bidding box and convention card holder in the preferred embodiment is readily detachable from the platform 1, so that support braces 2 with differing support leg angles 28 between the platform support 29 leg and the clamp support leg 30 may be attached to the platform 1. This necessitates the use of screws 26 and nuts 12, rather that rivets to permit interchangeability of differently angled support legs 2. Platform 1 and support brace 2 are shown attached to each other with the screw and nut combination. Alternatively as described in more detail below an angle adjustment mechanism is provided permitting adjustment of the angle between portions 29 and 30 of each support leg 2.

Figure 2:
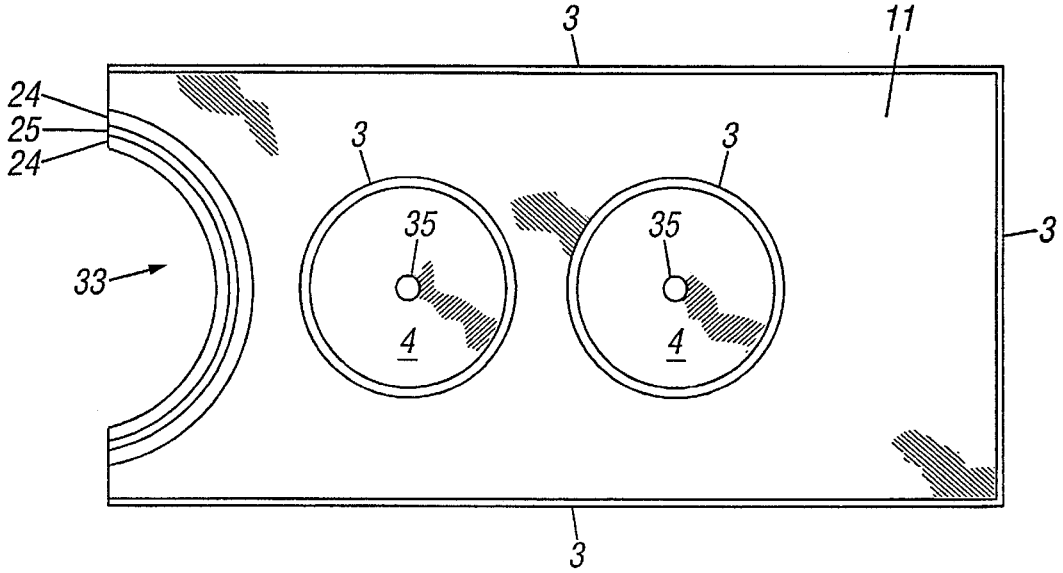
FIG. 2 is a top view of the platform of the food and beverage holder.
Figure 6:
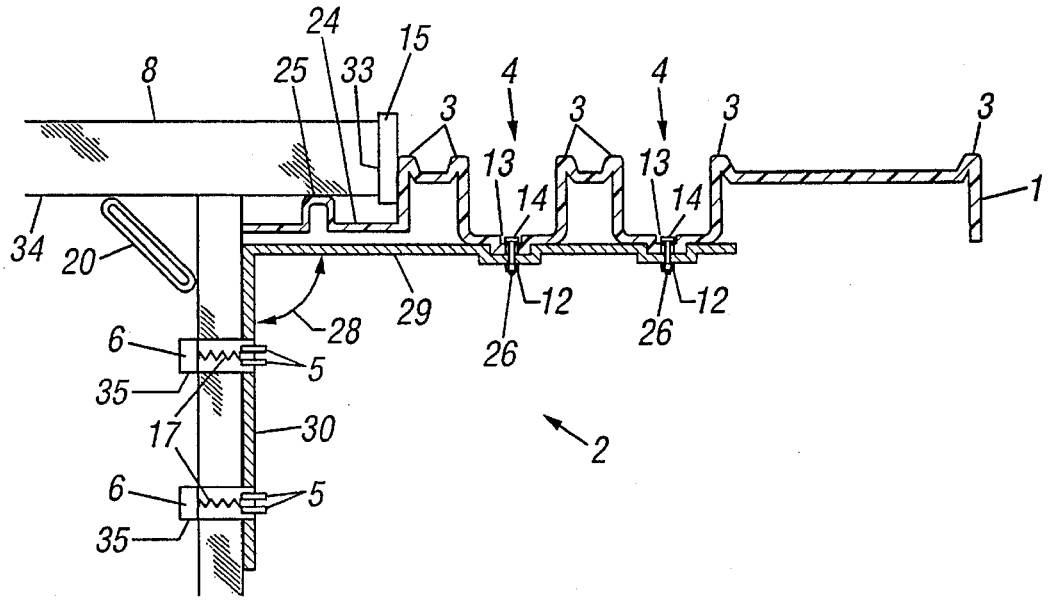
FIG. 6 is a cross sectional view of the platform and support leg, mounted to a collapsible card table.
Figure 7:
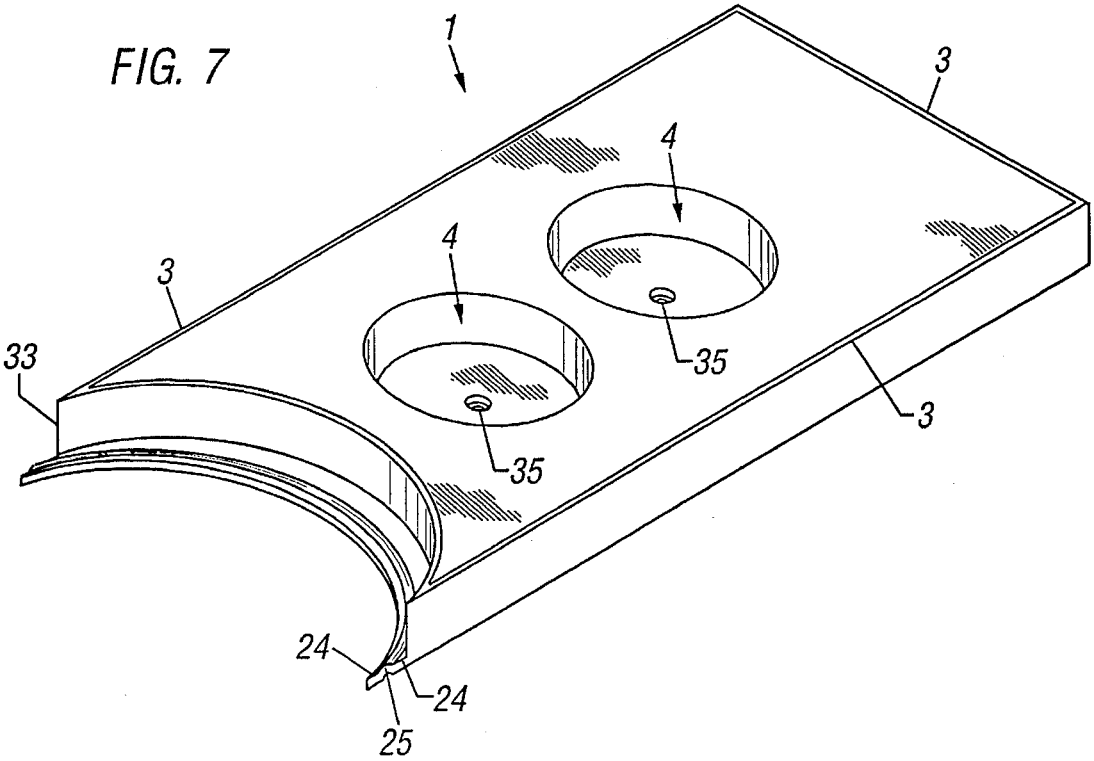
FIG. 7 is a perspective view of the platform.

As shown in FIGS. 1, 2, 6, and 7 the platform 1, which holds beverages in the beverage receptacle 4 of generally cylindrical shape, has raised ridges 3, which help keep round or cylindrical objects, such as pencils or pens, placed on the food platform surface 11 from falling into the beverage receptacles 4. Alternative uses for a beverage receptacle 4 include its use as an ash tray or a receptacle for food, money or other objects or game accouterments such as chips tokens or markers. The raised ridges 3 around the perimeter of the platform 1 serve to keep round or cylindrical objects, such as pencils or pens, from falling off of the platform 1 and onto the floor. As shown in FIGS. 2 and 7, flange extends downwardly about the perimeter of the platform generally perpendicular to the platform surface. As shown in FIGS. 2 and 7, the end of the platform 1 which is adjacent to the card table 19 has a notch in the perimeter which in the preferred embodiment has a rounded appearance or an arcuate surface to receive a "corner" of the table 19. Practically speaking, even card tables with round tops have "corners" as generally four legs are used on each and thus corners are defined by the positions of the legs, as well as of the players. The rounded arcuate configuration is readily adaptable to a wide variety of tables. Other alternative embodiments could use angled notches to accommodate various alternatively designed playing tables. This notch forms a perpendicular lateral stabilizing surface 33 from the flange at the notched portion of the platform. As shown in FIGS. 1 and 7, the corner of the table 19 fits into this perpendicular lateral stabilizing surface 33 which thus serves to restrict the lateral movement of the platform 1 due to either placing objects on or removing objects from the platform 1, or from a person walking by the table accidentally bumping the platform 1. As shown in FIGS. 1, 2, 6 and 7 extending from the notch at the perimeter of the platform is a ledge or horizontal stabilizing plane 24, which has a raised stabilizing ridge 25, that further serves to restrict the lateral movement of the platform 1 by "nesting" the upper surface of the stabilizing plane 24 and stabilizing ridge 25 configuration against the underside of a typical card table edge flange. The horizontal stabilizing plane 24 also serves as a brace against the table bottom 34, as objects are placed on the platform 1, across the fulcrum formed by the clamp support leg 30 as it is clamped to the table leg positioning the platform very close to the table railing 15.

As shown in FIGS. 2, 6, and 7, at the bottom of each beverage receptacle 4 is a recessed screw receptacle 13. These recessed screw receptacles 13 are designed so as to allow for the objects placed in the beverage receptacles 4 to lie flat on the bottom of the beverage receptacles 4, rather than having a bump in the middle of the beverage receptacles 4 caused by the screw head 14 that would cause objects with flat bottoms, such as a glass holding a beverage, placed in the beverage receptacle 4, to be unstable.

In the preferred embodiment as shown in FIG. 6, the platform 1 is held to the platform support leg 29 via a screw 26 and nut 12. Alternatively, the platform 1 and platform support leg 29 could be held together with a rivet, but such a configuration would be inferior relative to the use of a screw 26 and nut 12 combination because the player would then be unable to interchangeably use clamp support brace 2 of differing support leg angles 28, as has been mentioned previously. Referring to FIG. 6, the platform support leg 29 has recessed screw receptacles 13, into which the recessed screw receptacle 13 of the platform 1 fit, allowing for a tight fit between the top of the horizontal portion of the platform support leg 29 and the bottom of the platform 1.

Figure 3:
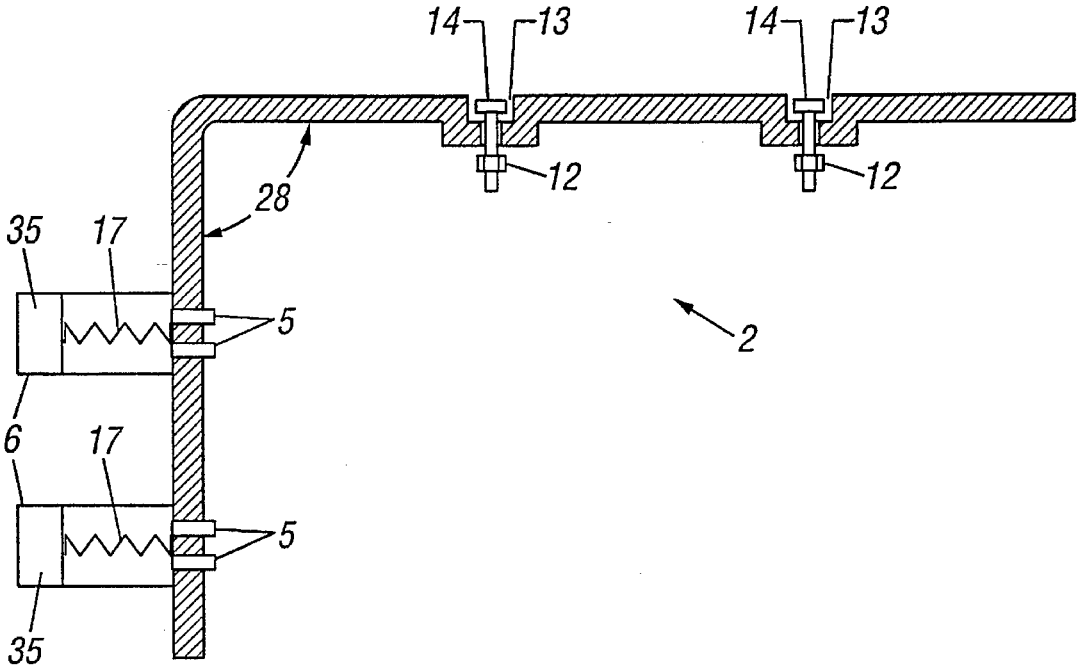
FIG. 3 is a side view of the clamp support leg and the clamps used to mount the apparatus to the table leg.

As shown in FIG. 3, the portion of the clamp support leg 30 that is in a generally vertical position and which lies next to the table leg 7 has in the preferred embodiment two spring-loaded clamps 6 attached to it by use of rivets 5.

As shown in FIG. 7, the flange 33 extending vertically down from the perimeter edges of the top surface of the platform 1 are of a depth generally equal to that of the beverage receptacles 4 (see FIGS. 1, 6, and 7). On the preferred embodiment illustrated in FIG. 1, which depicts a generally rectangular platform, the long vertical planar surfaces that are facing and proximal to the players, bidding boxes 9 can be attached to one or both sides. If the food, beverage, bidding box and convention card holder is mounted on the corner of the table to the right of the player, the bidding box 9 would be mounted on the vertical surface nearest the player, or on the left hand side of the platform 1 as seen from above and facing the card tables, with the player to the left of the person viewing the platform 1. For left handed players, the food, beverage, bidding box and convention card holder would be mounted to the table leg 7 on the player's left, and the bidding box 9 would be attached to the long vertical planar surface on the right hand side of the platform 1, if viewed from the top of the platform 1 facing the table 8 with the player to the left of the person viewing the platform 1. The bidding box would be attached to the platform using VELCRO® or its functional equivalent.

Figure 5:
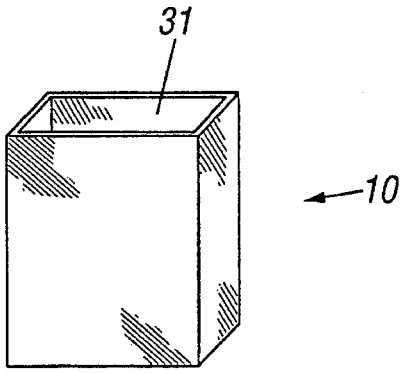
FIG. 5 is a perspective view of the convention card holder.

Referring to FIGS. 1 and 5, the convention card holder 10 would be attached to the short vertical planar surface that is the farthest part of the platform 1 from the table 8 using VELCRO® or its functional equivalent. The convention card holder would be used by the player, as well as the player's right hand opponent (if the player mounted the 10 food, beverage, bidding box and convention card holder to his right or left hand opponent (if the player mounted his food, beverage, bidding box and convention card holder to his left).

Figure 4:
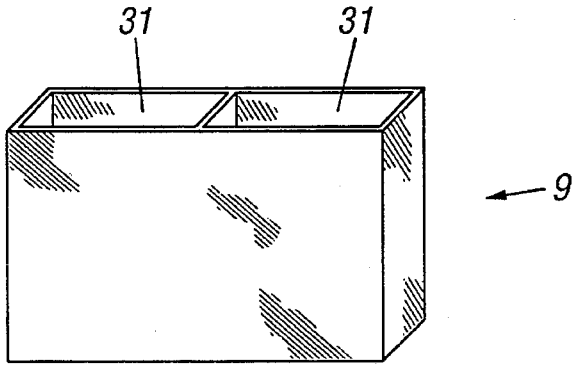
FIG. 4 is a perspective view of the bidding box.

The bidding box 9 (see FIGS. 1 and 4) has two card holding slots 31, one for bids (e.g. "one spade", etc.) and the other for calls made by the player other than bids (e.g. "pass", "double", etc.). The convention card holder has one card holding slot 31.

In the preferred embodiment the screws 26, nuts 12, rivets 5 and spring-loaded clamps 6 would be made of metal. The platform 1 and support 2 would be made of durable plastic, such as ABS plastic, using a vacuum forming process to minimize the cost of production of the molds used to form the plastic pieces. Injection molding using plastic, or stamping or forging the platform 1 and support 2 could be used, but the cost of manufacturing the molds would be higher.

Surgical-type tubing or other similar synthetic rubber tubing 35 or the equivalent would be used around the lips of the spring-loaded clamp 6 so that the table leg would not be marred by the clamp 6.

Figure 8:
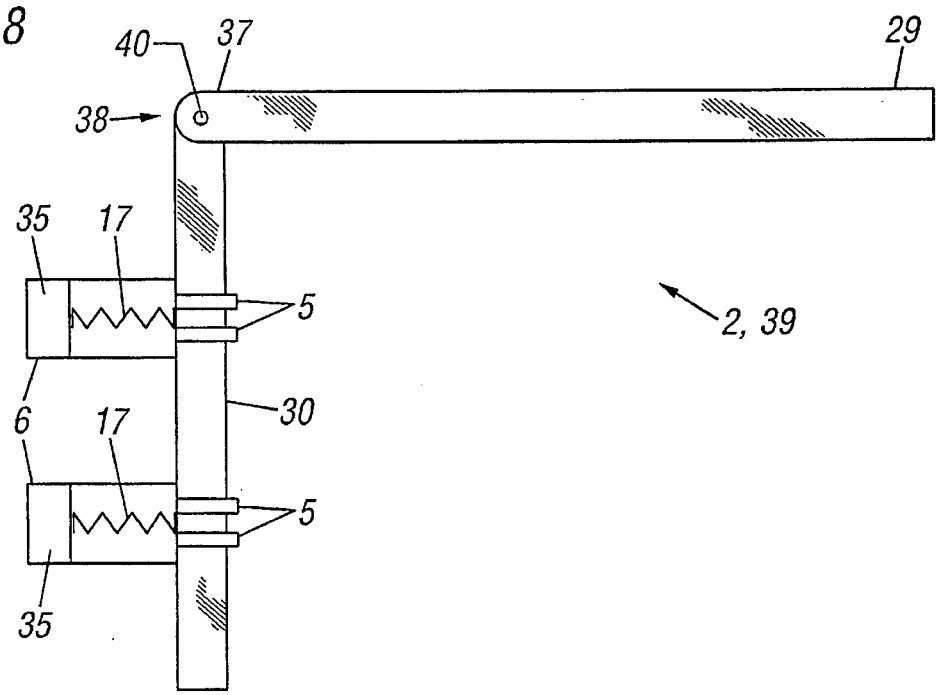
FIG. 8 is an alternative embodiment of the platform with angle adjustable supports.

In an alternative design, FIG. 8) the support leg 2 could be constructed so as to be universally adaptable to all tables 19 regardless of the inclination of the table legs 7 relative to the table to 19. As shown in FIG. 8, the pivotable support leg 39 would be formed out of two pieces: a clamp support leg 30 and a platform support 29. The clamp support leg 30 would have a clamp support leg flange with a hole in it at the end which would be attached to the platform support flange 37 with a bolt 26 and nut 12. The platform support 29 would have a platform support flange 38 which is perpendicular relative to the planar surface of the platform support 29 and a hole 40 is in the middle of the flange. The holes of the platform support flange 38 and the clamp support flange 37 would be aligned, and a bolt 26 and a nut 12 would be used to hold the platform support 29 and the clamp support leg 30 together and in a fixed position (i.e. at a specific support leg angle 28) as desired by the user. The nut 12 would be loosened to adjust the support leg angle 28 and tightened once the appropriate support leg angle 28 is achieved for the table to which the food, beverage, biding box and convention card holder apparatus 18 is to be mounted.

Figure 9:
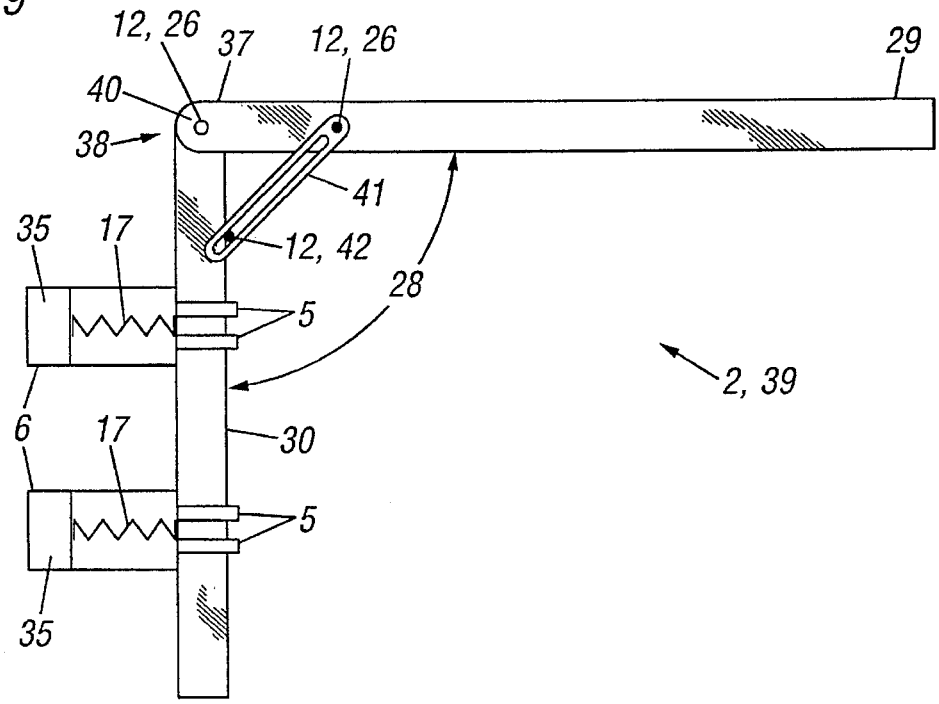
FIG. 9 is another alternative embodiment of the platform with angle adjustable supports.

In an additional alternative design, (see FIG. 9) the support leg 2 could be constructed so as to be universally adaptable to all tables 19, regardless of the inclination of the tale legs 7 relative to the table top 8. As shown in FIG. 9, the pivotable support leg 39 would be designed identically relative to the pivotable support leg shown in FIG. 8, except that, in addition, there would be a slotted support brace 41 which would act as a stabilizing support mechanism, or wedge, that would further serve to enhance the stability of the positioning of the platform support 29 and the clamp support leg 30 in a fixed position desired by the user. Near the clamp support leg 30 a bolt 12 and wing nut 42 would be used to fix the positions of the platform support 29 and the clamp support leg 30 relative to each other. On the other end of the slotted support 41, the slotted support 41 would be attached to the platform support 29 with a bolt 26 and nut 12.

As to the manner of operation and use of the present invention, the same is made apparent from the foregoing discussion. With respect to the above description, it is to be realized that although dimensional embodiments of specific materials is disclosed, those enabling embodiments are illustrative, and the optimum dimension relationships for the parts of the invention are to include variations in size, material, shape, form, function and manner of operation, assembly and use, which are deemed readily apparent to one skilled in the art in view of this disclosure, and all equivalent relationships to those illustrated in the drawings and encompassed in the specifications are intended to be encompassed by the present invention.

Therefore, the foregoing is considered as illustrative of the principles of the invention and since numerous modifications will readily occur to those skilled in the art, it its not desired to limit the invention to the exact construction and operation shown or described, and all suitable modifications and equivalents may be resorted to, falling within the scope of the invention.

What is claimed as being new and desired to be protected by United States Letters Patent is as follows:

1. An improved portable combination apparatus for mounting to the leg at the corner of a card ruble comprising:

a) platform means for receiving card game accouterments and refreshments, comprising a generally planar upper surface, a perimeter flange extending downward relatively from said upper surface, at least one notch means formed in said platform to receive the corner of a card table and a horizontal stabilizing ledge extending from the perimeter flange at the notch in said platform;

b) at least one support brace means for supporting said platform in position proximate the card table;

c) at least one retaining clip means for releasably securing said support brace to said card table leg; and, d) a raised stabilizing ridge on said ledge, for in combination with said ledge and said perimeter flange at said notch, nesting the upper surface of said ledge and ridge combination with the lower surface of a card table proximate the support leg of said card table.

2. The invention of claim 1 further comprising at least one card holding box means and detachable mounting means for mounting said box means to a said downwardly extending flanges around the perimeter of said platform means.

3. The invention of claim 1 further comprising at least one recessed beverage receptacle formed within the upper surface of said platform.

4. The invention of claim 1 wherein said support brace means comprises a first angle bracket means comprising a platform support leg extending horizontally beneath and supporting said platform, and means for securing said platform to said platform support leg, and a clamp support leg extending relatively downward from said platform support leg for attachment to the leg of a card table.

5. The invention of claim 4 wherein said means for securing said platform to said support leg comprises at least one threaded fastener.

6. The invention of claim 4 further comprising means for adjustment of the angle between said platform support leg and said clamp support leg.

7. The invention of claim 6 wherein said means for securing said platform to said platform support leg is releasable and said adjustment means comprises at least one additional angle bracket means with a different angle from said first angle bracket means for interchanging with said first angle bracket means.

8. The invention of claim 6 wherein said adjustment means comprises pivotable connection means at the intersection of said platform support leg and said clamp support leg and further comprises friction clamp adjustment means for releasably securing said legs at a given angle between said platform support leg and said clamp support means.

9. The invention of claim 8 wherein said adjustment means further comprises a slotted brace pivotably secured at one end to said platform support leg and a friction clamp means secured to said clamp support leg and mounted within said slot for securing said legs at a given angle by means of sliding said slotted bracket to the correct angle and tightening said friction clamp.

10. The invention of claim 9 wherein said friction clamp means comprises nut and bolt means.

11. The invention of claim 1 wherein said retaining clip means comprises at least two spring loaded clamps mounted to said support brace means by rivet means for attachment to the leg of a card table.

12. The invention of claim 11 further comprising an elastomeric coating for said spring clamp means to increase frictional resistance to sliding down the table leg and to protect the table leg surface.

* * * * *